United States Patent [19]

Gregg et al.

[11] 4,161,673

[45] Jul. 17, 1979

[54] ARC SUPPRESSION AND STATIC ELIMINATION SYSTEM FOR A TELEVISION CRT

[75] Inventors: Robert M. Gregg, Chicago; Philip C. Miller, Northbrook, both of Ill.

[73] Assignee: Zenith Radio Corporation, Glenview, Ill.

[21] Appl. No.: 811,494

[22] Filed: Jun. 30, 1977

[51] Int. Cl.[2] ..... H01J 29/02; H01J 29/84

[52] U.S. Cl. ..... 313/481; 313/450; 338/308

[58] Field of Search ..... 313/481, 479, 450

[56] References Cited

U.S. PATENT DOCUMENTS

| | | | |
|---|---|---|---|
| 3,267,321 | 8/1966 | Gessford | 313/441 X |
| 3,295,008 | 12/1966 | Gallaro et al. | 313/450 X |
| 3,882,348 | 5/1975 | Paridaens | 313/450 |
| 3,906,282 | 9/1975 | Krackhardt et al. | 313/481 |
| 3,909,655 | 9/1975 | Grimmett et al. | 313/450 |
| 3,961,221 | 6/1976 | Benda et al. | 313/481 |
| 4,018,717 | 4/1977 | Francel et al. | 313/479 |

FOREIGN PATENT DOCUMENTS

| | | | |
|---|---|---|---|
| 1448223 | 9/1976 | United Kingdom | 313/450 |

*Primary Examiner*—Robert Segal
*Attorney, Agent, or Firm*—John H. Coult

[57] ABSTRACT

For use in a cathode ray tube, an electron gun for generating at least one electron beam, the gun being characterized by having an elongated discrete arc suppression resistor mounted on an anode electrode of the gun in cantilever fashion at a point spaced from the beam so as not to interfere therewith, the resistor extending substantially axially and supporting on the distal end a getter strap to which it is electrically connected, the getter strap in turn supporting a getter pan assembly containing a vaporizable getter material.

9 Claims, 11 Drawing Figures

ARC SUPPRESSION AND STATIC ELIMINATION SYSTEM FOR A TELEVISION CRT

CROSS REFERENCE TO RELATED PATENT APPLICATIONS

This application is related to, but not dependent upon a number of copending applications of common ownership herewith, including Ser. No. 708,817, filed July 25, 1976, Ser. No. 803,907 filed June 6, 1977, Ser. No. filed Sep. 2, 1977, Ser. No. 802,223, filed June 1, 1977 now U.S. Patent No. 4,101,803, issued Jul. 18, 1978, all assigned to the assignee of the present application.

BACKGROUND OF THE INVENTION AND PRIOR ART STATEMENT

This invention relates primarily to an internal resistive system for television cathode ray tubes for protecting a tube and its associated circuitry from destructive electrical arcs and arc currents and for eliminating static charge accumulations inside the neck of a tube.

The envelope of a television cathode ray tube comprises a glass funnel and a mating faceplate. The funnel has a neck within which is located an electron gun. The faceplate of the tube has a fluorescent screen on which is impressed a very high DC voltage—typically in the range of 20–30 kilovolts or more. The screen is stimulated by one or more electron beams generated in the gun.

Conductive coatings on the inside and outside of the funnel serve as a large capacitor which filters the high voltage supplied to the screen. The inner conductive coating is at screen potential and also serves to transmit the screen voltage to the neck of the tube where it is applied to a high voltage anode electrode at the forward end of the electron gun.

The electron gun has one or more cathodes and a series of closely spaced electrodes which shape, accelerate and focus the electron beam(s) generated in the gun. To accomplish these functions, the various electrodes require widely different electrical potentials. The large voltage differences established between certain high voltage and low voltage electrodes in the gun creates a susceptibility to arcing between the electrodes, e.g., should there exist particulate foreign matter in an interelectrode space, a burr on an electrode, a misaligned or improperly spaced electrode, or the like. Large voltage differences between the gun electrodes and other tube internal components also establish arc-conducive conditions. When the conditions for arcing exist, the high voltage filter capacitor, with its immense stored electrical energy, will within a few microseconds or less dump its stored charge.

Because the instantaneous peak arc currents can reach hundreds of amperes in magnitude, great destruction can be wrought by such arcs. External circuitry can be damaged by transient currents and voltages induced in the associated receiver circuitry. Internal gun parts can be eroded to the point of inoperability or severely reduced in their effectiveness. High arc currents are capable of sputtering electrode materials onto adjacent surfaces, resulting in the formation of electrical leakage paths. Further, arcing in a tube during its normal operation can result in a loud audible report which may be quite disturbing to a viewer.

In recent years, the design evolution of color picture tubes has taken a direction tending to exacerbate the arcing problem. The design for greater picture brightness has driven the screen voltages inexorably upward toward and even beyond 30 kilovolts. A trend toward wider beam deflection angles and a desire to minimize power consumption have dictated the use of tubes with smaller neck diameters. A small neck diameter implies a more closely confined environment for the electron gun, with the attendant increased probability of arcing between components of the electron gun assembly or between the gun assembly and the containing tube envelope.

In order to reduce tube arcing, it is routine today to design color tubes and electron gun assemblies with every effort to maximize intercomponent spacing, to minimize points of field concentration, and otherwise to configure the tube and gun structures to minimize the tendency of a tube to arc. After a tube receives its electron gun and the envelope is sealed, it is commonplace to "spot-knock" (high voltage condition) the gun. "Spot-knocking" is an operation wherein a pattern of fluctuating and constant voltages of high magnitude are applied to the tube to "knock" (remove) loose particles which may have lodged between gun electrodes, burrs on electrode parts, and other agents which might lead to arcing of the tube during its normal operation. Typically peak voltages during spot-knocking are much higher than the screen operating voltage. Spark gaps, diodes, filters, gas discharge lamps, decoupling circuits, and other protective devices are commonly provided in the associated receiver (at significant cost) to protect receiver circuitry from damage by arc-induced currents and voltages.

Television picture tube manufacturers have long attempted to develop an internal resistive element which would be coupled in series with the high voltage filter capacitor and the electron gun to suppress the magnitude of arc currents and thereby overcome the potentially destructive effects of arcing in the tube during tube operation.

The requirements for such an internal resistance element are, however, extremely severe. Following are some of the requirements, not necessarily in their order of importance, of an internal resistive element or system of elements for protecting a television picture tube against arcing.

Requirement 1

The resistive element or elements must be compatible with the clean high vacuum environment inside a cathode ray tube. The element or elements cannot emit gas which might significantly decrease the tube's vacuum level or impair the performance of the cathode in the electron gun assembly. The element or elements cannot flake, erode, ablate, or otherwise generate particles which might block openings in a color selection electrode or lodge in a gap between gun electrodes.

Requirement 2

The resistive element or elements must be compatible with the tube's fabrication processes. Perhaps the most severe of the fabrication processes are the high temperature cycles which a color tube is subjected to when the faceplate is sealed to the funnel and during exhausting (and sealing) of the tube. Temperatures may reach 430° C. or higher during these high temperature operations.

Requirement 3

The resistive element or elements cannot be physically obtrusive to the electron beams. As noted, there is a very limited amount of space available in the neck of a television cathode ray tube, particularly a tube of the small neck type, and particularly in the region near the front of the electron gun. Because of this space limitation, it has proven to be difficult to design a non-obtrusive discrete internal resistive element.

Requirement 4

The resistive element or elements must be capable of being satisfactorily electrically terminated at each end. If the resistive element is a neck coating, it has been found that even modest arc currents are apt to cause localized heating of the glass underneath the contact point(s) with the result that the glass may chip or become predisposed toward eventual failure. It is difficult to maintain contact integrity with such an element after a number of arcs have occurred.

Requirement 5

The television industry being highly competitive, the resistive element or elements and the associated cost of installation must be low enough to be commercially viable.

Requirement 6

Another requirement is that any resistive element or system of elements not be susceptible to being by-passed by an arc as a result of the deposition of conductive material during flashing of a getter in the tube. Specifically, all television cathode ray tubes today utilize a "flashed" (vaporized) "getter" material which "gets" (adsorbs) residual gas in the tube after the tube has been pumped down as far as is practicable and sealed off. The gas-adsorptive getter material most commonly employed is a barium compound. Barium is highly conductive, however. When the getter is flashed, a conductive barium coating is deposited on substantially all exposed areas within the tube. In order to "get" the greatest quantity of residual gas, the getter must be flashed over a wide area inside the tube; inevitably, getter material is deposited on the resistive element. It is clear that any resistive element or system of elements used for arc suppression or static elimination will be effectively by-passed or nullified if a shunt path around the resistive element or elements or a major part thereof is created by conductive getter material.

Requirement 7

Yet another requirement is that the elements or elements not break down at operating or conditioning ("spot-knocking") voltages.

Requirement 8

A very important requirement is that the effective impedance of the resistive element be within an appropriate resistance range. If the dynamic impedance of the element is too low, e.g. below a few kilohms, inadequate suppression of arc currents will be provided. A resistive element may have an appropriate DC resistance measured outside of the tube but, when situated in a finished tube, be shunted by a stray capacitance which is so high as to establish a low dynamic parallel impedance across the element. It is believed that the afore-described stray capacitance problem has not been fully appreciated by prior practitioners in the art.

If the DC resistance of the element is too high (e.g. $10^{12}$ ohms), the material will act as an insulator and collect stray charges which may alter the electron beam paths or initiate arcing. Further, if the DC resistance of the element is too high, the voltage drop across the element as a result of gun leakage current flowing through it will result in an intolerable drop in the voltage applied to the anode electrode of the gun.

One approach to arc suppression disclosed in the prior art is to deposit an electrically resistive coating on the inner surface of the envelope at the lower end of the tube funnel or in the neck, which coating makes contact at one end with the inner conductive coating on the funnel and at the other end with the electron gun assembly. Perhaps the first patent to suggest such an approach to arc suppression is U.S. Pat. No. 3,829,292—Krause. See also U.S. Pat. Nos. 3,355,617 and 3,961,221, German Pat. No. 2,634,102, and Technical Note 039, published on Mar. 1, 1977 by N. J. Phillips Gloeilampenfabrieken.

U.S. Pat. No. 3,979,633 discloses a color cathode ray tube having an arc suppressive resistive coating between the gun and the inner conductive coating on the funnel. FIG. 1 is in part a reproduction of the first figure in prior art U.S. Pat. No. 3,979,633. U.S. Pat. No. 3,979,633 discloses a color cathode ray tube 11 having a neck 13, a funnel 15, and a face panel 17. The funnel 15 has an outer conductive coating 29 and an inner conductive coating 33. The inner conductive coating 33 is accessed through a high voltage anode button 35 passing through the funnel wall. The outer and inner conductive coatings form a smoothing filter capacitor for high voltage supplied to the tube from a high voltage power supply 36. Circuitry for driving the tube's electron gun is shown schematically at 38. Power supply 36 and gun drive circuitry 38 have been added to FIG. 1 of U.S. Pat. No. 3,979,633 for clarity of illustration.

The FIG. 1 prior art tube is disclosed as including an arc suppression system comprising a "high resistive coating" 39 on the interior surface of the funnel 15 in the region at which the neck 13 joins the funnel. The resistive coating 39 is electrically joined at its forward end with the inner conductive coating 33. At its rearward end, it is contacted by a snubber spring 49 on an anode electrode 45 constituting part of the electron gun assembly.

The resistive coating 39 is said to be comprised of a glass frit-based composition having, for example, suitable metallic oxide inclusions. The resistive coating is said to have a resistivity of, for example, $10^5$ to $10^7$ ohms per square. The arc suppression system described is said to provide a resistive path between the conductive anode button 35 and the anode electrode 45 of the gun assembly having a DC resistance value of 0.5–10 megohms. It is said that in tubes employing the described arc suppression system peak arc currents seldom exceed 0.5 to 1.0 amperes.

The U.S. Pat. No. 3,979,633 disclosure asserts that prior art systems which use an arc suppression coating, such as disclosed in U.S. Pat. No. 2,829,292, are deficient in that "it was found that getter and other sublimation deposits within the tube tended to bridge the resistance coating, thereby decreasing the intended benefit" (column 2, line 7). U.S. Pat. No. 3,979,633, in order to provide arc suppression while preventing the shorting of the high resistive coating 39 by deposited getter material, provides a modification of the getter "having a discretely shaped diffusion director integral therewith and oriented on a component structure within the tube to discretely direct the effusion of getter material in a manner to prevent the formation of a conductive path across the high resistive coating 39" (column 4, lines 45–50).

Two different getters are shown in FIG. 1—one at 51 and the other at 63. Each of the getters is structured and orientated with the intent that when it is flashed, the getter material does not fall upon and short circuit the high resistive coating 39.

The disclosed U.S. Pat. No. 3,979,633 approach of averting the getter flash deposition pattern away from the high resistive coating 39 in order to prevent shorting of the coating, is believed to be unsatisfactory. Getter 63 is located on the shadow mask and is not removable from the tube when the neck is taken off to salvage and reconstitute the tube. Also, attachment of the getter 63 to the mask is apt to alter the mechanical or thermal characteristics of the mask. Regarding getter 51—it is known to be difficult to mount a ring getter about the beam egress from the gun which does not interfere with the electron beams. Also, it has been found that ring getters mounted within the neck are in an inefficient position for maximizing getter flash area and getter pumping efficiency. Also, such ring getters produce an undesired back diffusion of getter material on nearby gun parts.

An arc suppression coating deposited on the inner surface of the neck and funnel rules out the use of a gun-mounted antenna-type getter, with its attendant universally recognized advantages, lest the arc suppression coating be shunted by the antenna strap.

Another serious problem associated with an arc suppression coating on the inner surface of the envelope is the high stray capacitance which can be created, especially when the tube is assembled and the yoke and other external components are mounted on the neck of the tube.

Let us explore further the effects of the stray capacitance, sometimes referred to as parasitic capacitance, which exists in the neck region of a television CRT, specifically a tube which has an arc suppression resistor in series with the high voltage filter capacitor and the electron gun.

The following discussion regarding stray capacitance and its effects in a television CRT is derived from the referent U.S. Patent No. 4,101,803. FIG. 2 is a hypothetical curve of arc current versus time during an arc in such a television CRT. FIGS. 3, 4 and 5 are schematic stray capacitance diagrams at three different times during an arc. In FIGS. 3, 4 and 5, $C_F$ is the high voltage filter capacitor on the funnel of the tube. $C_{S1}$ represents stray capacitance existing across the arc suppression resistor R. $C_{S2}$ represents stray capacitance across a gun inter-electrode gap G. $C_{S3}$ represents stray capacitance between some intermediate point on the arc suppression resistor and the negative side of the filter capacitor $C_F$ (typically at ground potential). It should be understood that whereas only stray capacitances $C_{S1}$, $C_{S2}$, and $C_{S3}$ are shown, in reality stray capacitance exists between each point and all other points on the internal tube components.

FIG. 3 illustrates the condition inside the tube at time $t_0$ before an arc has been initiated. FIG. 3 schematically shows that a high voltage derived from the charged filter capacitor $C_F$ appears across an interelectrode gap G. Between $t_0$ and $t_1$ (before an arc actually occurs) it is known that a low level flow of charge builds up. At time $t_1$ the gap G is closed, as by a conductive discharge plasma bridging the gap G.

FIG. 4 depicts events between times $t_1$ and $t_2$. As a result of the closing of gap G, the high voltage developed across capacitor $C_F$ now appears across the arc suppression resistor R, causing the stray capacitances $C_{S1}$ to charge up and the previously charged stray capacitance $C_{S2}$ to discharge nearly completely and capacitance $C_{S3}$ to partially discharge. The result is a very brief current transient. The main arc current has not yet begun to flow.

FIG. 5 illustrates the condition existing between time $t_2$ and $t_3$ when the high voltage filter capacitor is dumping its charge through the arc suppression resistor R; $t_3$ represents a time at which the arc self-extinguishes. The portion A of the FIG. 2 curve between times $t_2$ and $t_3$ is the RC curve associated with the discharge of the capacitor $C_F$ through the arc suppression resistor R. The higher the product of $C_F$ and R (the longer the RC time constant), and the lower is $I_D$ (the peak current associated with the discharge of capacitor $C_F$), the less will be the arc power which must be dissipated and the lower the likelihood of component damage and/or receiver performance impairment. The total duration of an arc discharge, including the precursor events, is no more than a few microseconds.

It is worth noting that in a conventional television CRT without arc suppression, the arc-current-versus-time curve, corresponding to FIG. 2, is a towering spike which may reach 1000 amperes peak current, or greater. The potential for destruction of arc currents of such magnitude is obvious.

Although the part played by stray capacitance within a television CRT during arcing of the tube has not been widely recognized, there has been some limited appreciation of the effects of stray capacitance evidenced in certain prior art patents. For example, this subject is discussed in some detail in U.S. Pat. No. 3,909,665—Grimmet et al., column 4, lines 49 et seq. Grimmet et al. in column 4 (line 64) states:

> "It has been found that the presence of a resistor between the internal coating and the final anode contributes to the stray capacitance in a manner which depends mainly upon the physical size of the electrically conductive material of the resistor."

At the top of column 5 Grimmet et al. goes on to say it was found that in a cathode ray tube having a resistor in which the resistive element is deposited on the inner surface of the neck of the envelope, the stray capacitance is 20 picofarads, whereas in a cathode ray tube differing only in that the resistor is constructed and arranged as described in Grimmet et al., the stray capacitance is 3 picofarads. The Grimmet et al. design does not show the arc suppression resistor on the inner surface of the envelope, but rather places it on the inner surface of an insulative cylinder which is mounted on the forward end of the electron gun and coaxial therewith.

Grimmet et al. leads us to a discussion of the second basic approach to providing arc protection by means of an internal arc suppression resistive element. This second approach is to provide a discrete resistor between the inner conductive funnel coating and the forward end of the electron gun.

The Grimmet et al. arc suppression resistor is, as noted, of the discrete type. Another arc protection execution quite similar to Grimmet et al. is disclosed in U.S. Pat. No. 3,882,348—Paridaens. The Paridaens patent discloses an arc suppression resistor in the form of a cylinder coaxially mounted on the end of a three-beam electron gun. A 500—ohm helical resistive wire is coiled around the outside of the cylinder and is connected in series with the inner conductive coating on the funnel and the anode electrode of the gun. The cylinder is constructed of a ceramic material having "some but very small conductability." The resistance of the cylinder is said to be $10^8$ ohms—a value selected to prevent charging of the surface of the cylinder.

By placing the resistive element on the outside of the ceramic cylinder, the Paridaens approach will not achieve the reduction in the stray capacitance sought by Grimmet et al.; recall that in Grimmet et al. the resistive element was placed on the inner surface of an insulative cylinder. However, like Grimmet et al., the Paridaens ceramic cylinder mounted on the foward end of the gun is very apt to interfere with the electron beams, especially in the tubes of the popular small neck variety. The low resistance value (500 ohms) and physical shortness of the Paridaens resistor are deemed to be further shortcomings of the Paridaens approach.

The referent copending application Ser. No. 708,817 also discloses (in one embodiment) a discrete arc suppression resistor in the form of a cylinder mounted on the forward end of the electron gun. The resistor disclosed is novel in its provision for shadowing the exposed surface of the resistor from getter flash deposits and in its supporting of a getter assembly.

We believe that the Paridaens and Grimmet et al. patents evidence an appropriately directed effort toward a structure having reduced stray capacitance, but the executions revealed in those patents appear to have serious limitations. The reduction in stray capacitance in going from an arc suppression coating on the neck of the tube to a gun-mounted cylindrical resistor is only a part way measure. (The stray capacitance is not reduced significantly in these designs since the area of the cylinder mounted on the end of the gun is nearly as great as the internal area of the inner surface of the neck.) Further, the discrete cylindrical resistor inevitably encounters beam obstruction problems, especially in small-neck tubes, and high cost. As will be discussed in detail below, we have recognized that from the stray capacitance standpoint it would be ideal to have a discrete arc suppression resistor which is located on the tube axis and is of infinitesimal cross-section, as shown at 65 in the schematic FIG. 5A sketch. This geometry would produce the minimum possible stray capacitance, it is believed, since stray capacitance is a direct function of the electrode area and the dielectric constant and an inverse function of the separation of the capacitor electrodes. This ideal FIG. 5A geometry for a discrete arc suppression resistor is not completely achievable. However, as will be explained, this invention teaches a discrete arc suppression resistor geometry which closely approaches the FIG. 5A ideal geometry.

Two other inter-related design considerations are: (1) the physical length of the resistor, and (2) the effective path length that is created for an arc traveling through the resistor (hereinafter referred to as the "arc path length"). Ideally, the physical length of the resistor should be short to minimize any possible interference of the resistor with the electron beams as they are deflected across the screen, and to minimize stray capacitance associated with the resistor (a function also of the physical length of the resistor). Conversely, however, it is extremely important that the arc path length be as long as possible to minimize the possibility of an arc jumping over all or a part of the resistor. In attempting to balance these apparently conflicting considerations, there must be kept in mind the need for mechanical simplicity, low cost, ability to provide terminations, and susceptibility to arc path length shortcutting by an arc (as with a helix geometry, for example).

British Pat. No. 1,448,223 to Anderson et al. discloses a single beam CRT having a discrete arc suppression resistor, while appearing to represent an effort in a potentially fruitful direction, is nevertheless believed to be unworkable. The Anderson et al. arc suppression resistor in its primary FIGS. 1–2 embodiment comprises a hollow ceramic cylinder mounted on the end of a one-beam gun which carries a helical resistive arc suppression coating. The Anderson et al. FIGS. 1–2 resistor is little more than a variant of the Paridaens and Grimmet et al. approach.

As noted, a helical resistor geometry is very poor from the standpoint that it encourages arc cascading or jump-over from one turn to the next with consequent short circuiting of all or a portion of the resistor.

The FIG. 3 embodiment of Anderson discloses a cylinder of the same general construction as disclosed in the FIGS. 1–2 embodiment, but offset laterally from the electron beam and being solid rather than hollow. The beam is shielded by a hollow tube which is axially coextensive with the cylindrical arc suppression resistor. It is believed that this configuration would be clearly inoperative, not only because a helically wound resistor is employed, but also because the shield offers, in effect, a by-pass for an arc around the arc suppression resistor. Further, the resistor cylinder is so bulky as to be inapplicable to modern day color tubes by reason of beam interference alone. Other embodiments disclosed in the Anderson et al. patent are mere variations of the FIG. 3 embodiment wherein more than one resistor or more than one opposing support post are added for greater structural stability of the resistor assembly. Anderson et al. suggests that the beam shield might be removed, however the question of interference with the beam by electric fields generated across the resistor if the shield were removed, remain unanswered.

In summary, considering the Anderson et al. arc suppression approach from a systems standpoint, it clearly appears to be subject to the afore-described susceptibility of prior art systems to being by-passed by an arc. From the standpoint of its disclosure of an improvement in discrete arc suppression resistors, it clearly falls short of disclosing a resistor which would be useful in any modern day color tube.

U.S. Pat. No. 3,295,008—Gallero et al. expounds another prior art disclosure of a discrete arc suppression resistor. In Gallero et al. the resistor is a small element forming part of a snubber spring assembly. The Gallero et al. resistor, being physically small, avoids the beam interference problem but suffers from the fact that getter flash deposits on the surrounding neck inner surfaces and on the resistor itself will quite likely act to permit a by-passing of the resistor by an arc. Also, the physically short Gallero resistor will, we believe, be easily jumped over by an arc.

Another important consideration in the design of television cathode ray tubes is to assure that no static charge is built up in the neck of the tube which could initiate arcing or create stray electrical fields capable of diverting the electron beams from their intended paths. In conventional television CRTs (which do not have arc suppression systems), the inner surface of the neck is coated with the same colloidal graphite material which serves as the inner conductive coating on the funnel. Such a conductive neck coating is effective to drain off any stray charge falling on the inner wall of the neck and prevent charging up thereof.

However, in any system which has a discrete arc suppression resistor, it is not so easy to provide means for draining off stray electron charge. If the same inner conductive coating is used as is employed in conventional tubes without arc suppression systems, it is very likely that an arc will traverse the coating and directly by-pass the resistor, or will shunt the resistor through the high stray capacitance which is created by such a coating. If a system such as discussed above is used, wherein a resistive coating is deposited on the inner surface of the neck to serve as an arc suppressor (and static charge drain), then there arises the aforedescribed glass-chipping, contact integrity and other problems associated with resistive neck coatings which are designed to carry arc currents.

The referent U.S. Patent No. 4,101,803 teaches a general solution to the aforesaid problems of providing arc suppression and static charge drain in a system comprising, in electrically parallel combination, a discrete arc suppression resistor and an anti-static coating deposited on an inner surface of the neck around the beam egress from the gun. This invention is described in that referent application as representing a preferred embodiment of that invention. As will be explained, aspects of this invention are a system comprising an improved parallel combination of an anti-static neck coating and an improved discrete arc suppression resistor.

OTHER PRIOR ART

U.S. Pat. No. 3,267,321
U.S. Pat. No. 3,469,049
U.S. Pat. No. 3,950,667
U.S. Pat. No. 3,758,802

OBJECTS OF THE INVENTION

It is an object of the present invention to provide for television cathode ray tubes an electrically resistive system for arc suppression and static elimination which is improved in its very low susceptibility to being shorted by getter flash deposits, in its low stray capacitance and series resistance damping of the stray capacitance, and high dynamic impedance (and thus arc-suppressing-ability), in its relatively long effective arc path length, in its avoidance of physical obstruction of the electron beam deflection space, in its very low susceptibility to an arc jumping over the resistor, and in its modest cost of manufacture.

It is another object to provide such a resistive system in which a number of the aforesaid improvements are primarily attributable to an improved discrete arc suppression resistor constituting part of the system. The discrete resistor has a geometry which provides inter alia, a relatively long arc path length while avoiding interference with the electron beams, which provides minimized stray capacitance and maximized series resistance damping of the stray capacitance, which has high mechanical strength and readily adapted for electrical termination, which provides a very high degree of immunity from shorting of its surface by getter flash deposits.

It is yet another object to provide such a discrete resistor which is readily permissive of use with the popular antenna-type gun-mounted getters.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Figures 6, 6A, 7:
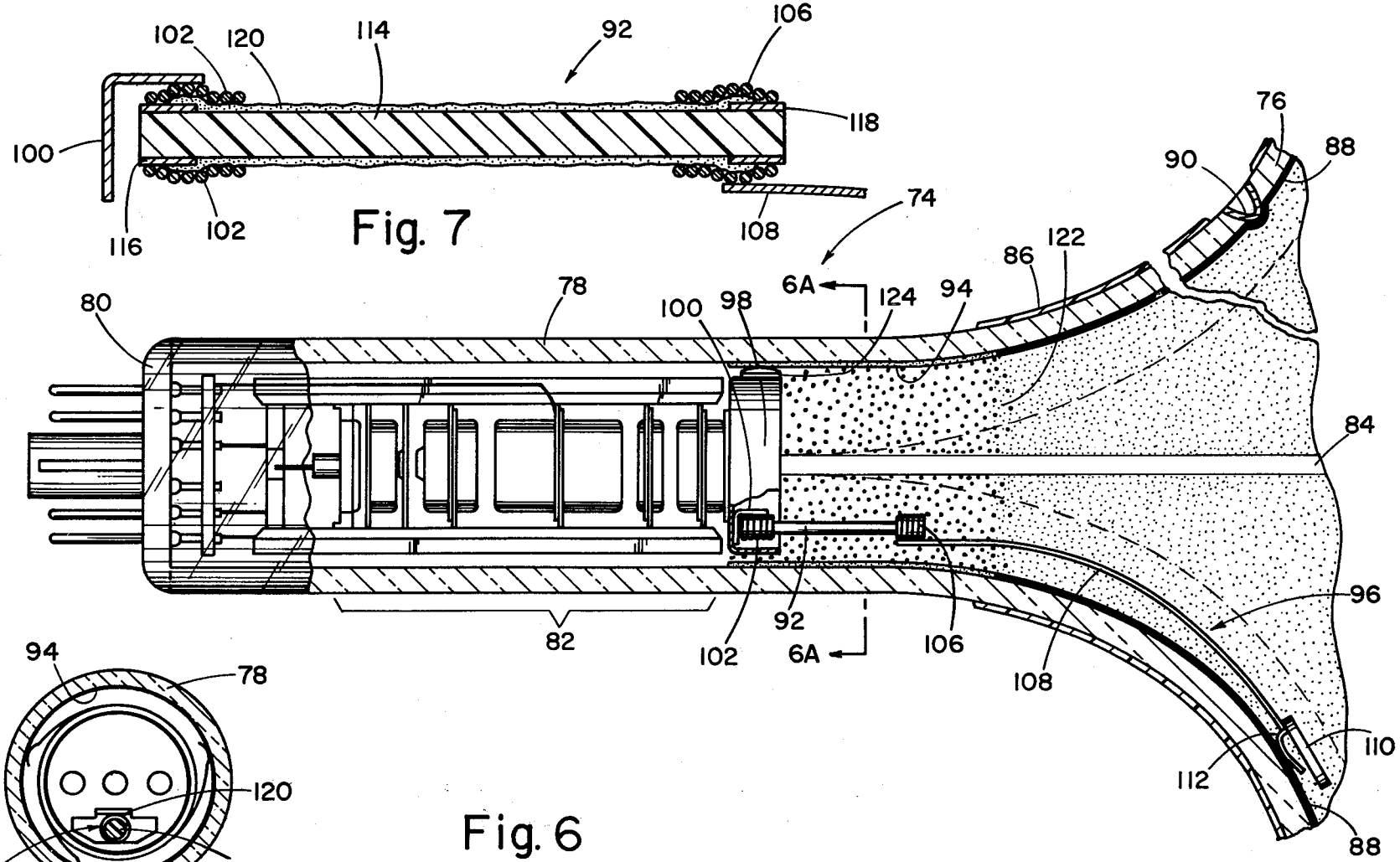
FIG. 6 is a sectional side view of a portion of a color cathode ray tube embodying the teachings of the present invention.
FIG. 6A is an enlarged front elevational view, partially sectioned, of an electron gun comprising part of the FIG. 6 tube.
FIG. 7 is a side elevational view of a discrete arc suppression resistor constructed according to the invention; it is shown in diminished scale in FIG. 6.

The present invention concerns a resistive system for use in television cahode ray tubes for protecting the tube and associated receiver circuitry from arcs and arc currents, and also for eliminating static charge from the interior of the neck portion of the tube. A preferred implementation of the principles of the present invention will now be described. FIG. 6 is a partially sectioned side view of a portion of a color cathode ray tube embodying the present invention. Before discussing the present invention, however, certain tube components which comprise the environment for the present invention will be described.

The FIG. 6 tube 74 implementing the present invention is shown as including a portion of a glass funnel 76 joined with a neck 78. The neck 78 is terminated by a base 80 supporting a number of pins through which electrical communication is made between the television chassis and the interior of the tube 74.

In the neck of the tube is disposed an electron gun assembly 82 which generates three coplanar beams, shown edge-on at 84. The tube includes an outer conductive coating 86 which is maintained at ground potential and an inner conductive coating 88 which receives a high voltage from an exterior source (not shown) through an anode button 90. The outer and inner conductive coatings 86, 88 constitute a high voltage filter capacitor and may be of conventional composition. The capacitance value of the filter capacitor of a modern color CRT is typically in the range of 1000–2000 picofarads.

In accordance with the invention described and claimed in the referent U.S. Patent No. 4,101,803, as improved by the present teachings, the tube 74 includes an arcsuppression and anti-static resistive system including an improved discrete arc suppression resistor and, in parallel therewith, an anti-static neck coating. As will become more evident hereinafter, the resistive system according to this invention has a number of unique properties. To prevent stray capacitive by-passing of the resistive system by arc currents, the system has a stray capacitance which is low in value. The very modest stray capacitance is, for the most part, serially coupled with largevalued resistance to strongly damp arc currents charging and discharging the stray capacitance. Having both a large DC resistance and a very large capacitive reactance (due to the low value of the stray capacitance), the overall dynamic impedance of the system of resistive elements is high.

Whereas numerous other embodiments are contemplated, a preferred embodiment is depicted in FIGS. 6. The preferred embodiment comprises a parallel combination of an improved discrete arc suppression resistor 92 according to this invention and an anti-static coating 94 on a portion of the neck surrounding the beam egress from the gun. Anti-static coating 94 will be discussed, followed by a detailed treatment of the arc suppression resistor 92. The anti-static coating 94 comprises an important component of the resistive arc suppression system. The anti-static coating serves to drain off stray charge and to transmit the high voltage on the funnel inner conductive coating 88, yet does this with a low cost coating with a low stray capacitance which serves to damp stray capacitive charging currents (and discharging currents), and which otherwise meet the afore-stated requirements of an internal resistive element for a CRT.

The anti-static coating 94 overlaps and makes electrical contact with the inner conductive coating 88 along an overlap 122. At the gun end of the anti-static coating 94, the coating is electrically and physically contacted by a plurality of snubber springs 124 carried by the anode electrode 98. A uniform anode potential is provided in the area of the anti-static coating 94 by means of the high voltage applied to the inner conductor 88. As will be described in detail hereinafter, the preferred material for the coating 94 is resistive frit. In a subsequent section the part played by the anti-static coating 94 and its features and attributes will be described in more detail.

The improved arc suppression resistor 92 according to the present invention will now be discussed—first its structure, then its attributes. The arc suppression resistor 92 is mounted on an anode electrode 98 constituting part of the last element of the main focus lens of the gun assembly 82. It, in turn, supports a getter 96. See FIGS. 6, 6A and 7. The arc suppression resistor 92 is supported by a bracket 100 welded to a coil spring connector 102. The resistor may be supported at a slight angle away from the tube center axis—e.g. about five degrees—for improved beam clearance. At the opposite end of the resistor 92 is a second coil spring connector 106 which is similar to the connector 102. The particular structure of the connectors 102, 106 does not constitute an aspect of the present invention, per se, but rather is described and claimed in the referent copending application Ser. No. 830,270, filed Sep. 2, 1977.

Although a variety of other resistor configurations of both the bulk resistor and coated substrate type are contemplated, in the illustrated preferred embodiment the resistor 92 is shown as comprising a cylindrical rod 114 of about ⅛ inch diameter composed of ceramic, glass, steatite or other suitable material. The rod is long and narrow, e.g. having a length-to-width ratio of about 8:1 to 20:1. On the opposed ends of the rod are deposited conductive termination coatings 116, 118—nickel, silver, iridium, or gold, for example. A resistive coating 120 of high resistivity covers the rod 114, overlapping the metal termination coatings 116, 118 in order to assure the integrity of the electrical connection between metal termination coatings 116, 118 and the resistive coating 120 under high vacuum arcing conditions. As will be explained in more detail below, the resistive coating may have various compositions, but is preferably a resistive frit.

The coil spring connectors 102, 106 serve to provide a sound mechanical and electrical connection with the ends of the resistor 92. The connectors 102, 106 are expanded coil springs and very securely grasp an inserted end of the rod. Due to their compliant nature they follow the step at the end of the resistive coating 120 and make good electrical contact with not only the metal termination coatings 116, 118, but also with the end of the resistive coating 120. After the connectors 102, 106 have been permitted to constrict upon the ends of the rod 114, they are locked in place by welding on the bracket 100 and getter support 108.

A getter pan support in the form of an electrically conductive leaf spring getter strap 108 is welded to the coil spring connector 106 and at its distal end carries a getter pan 110. The strap is curved to follow the contour of the flare region of the funnel. The pan 110 is supported on runners 112 in firm physical and electrical contact with the inner conductive coating 88. Thus is the high electrical potential on the coating 88 conveyed to the anode electrode 98 of the gun assembly 82.

The pan carries a quantity of conventional getter material—for example a gas-doped barium compound. The getter is "flashed", i.e. the getter material is vaporized, to coat the inner surfaces of the tube by heating the pan using an RF (radio frequency) induction source located outside the tube enclosure.

Should conditions exist for an arc to occur in the gun, for example, as a result of a foreign particle lodging in a narrow inter-electrode space in the gun assembly 82, an arc current will propagate through the getter runner 112, strap 108, arc suppression resistor 92, through the gun assembly 82 and associated gun drive circuitry to a ground within the receiver.

A discussion of the features and attributes of the improved discrete arc suppression resistor 92 and the system of which it is a part, will now be engaged. It should be kept in mind that the design of the arc suppression resistor 92 must take into account a significant number of inter-related design factors. The stray capacitance of the resistor is very important, as is the effective arc path length established across the resistor, the potential for electron beam obstruction by the resistor, the susceptibility of the resistor to being shorted by getter flash, the reliability of the resistor (which concerns such factors as its terminations, mechanical strength, shock resistance, simplicity, etc.), and cost of manufacture.

Figure 5:
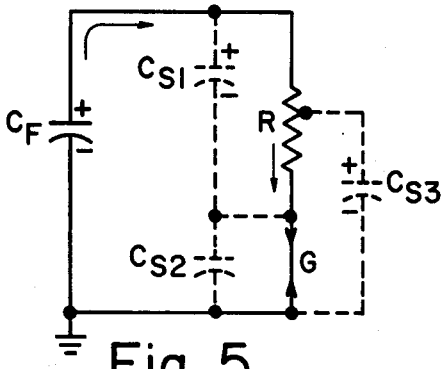
Figure 5A:
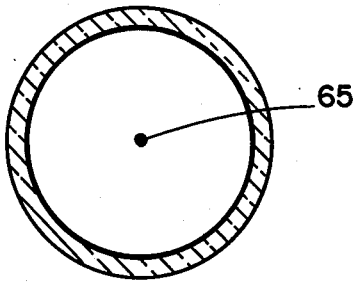
FIG. 5A is a schematic view of a hypothetical discrete arc suppression resistor idealized for minimum stray capacitance.

As intimated above, the arc suppression resistor 92 according to the present invention closely approximates in its stray capacitance that of the idealized resistor shown at 65 in FIG. 5A. As noted, the stray capacitance of the resistor 92 is a direct function of the area of the surface of the resistor and an inverse function of the spacing of the resistor from other tube components—principally from the neck coating on the tube and external neck components such as the yoke. (Stray capacitance exists, of course, between the resistor and all other components in the neck region of the tube which are capable of holding a charge.) The resistor 92 has a finite spray capacitance component but due to its small perimeter, the surface area of the resistor per unit length is small, and the effect on stray capacitance of resistor area is minimized. Secondly, whereas it is conjectured that a location of the resistor 92 on the tube axis would result in a minimized effect on stray capacitances due to inter-electrode spacing, such a location would of course put the resistor directly on the axis of the center beam. Location of the resistor vertically spaced from the deflection space traced by the three electron beams 84, however, approximates the effect on stray capacitance that would be achieved by locating the resistor on the axis of the tube. It is believed that the variation from the minimum value, if any, due to inter-electrode spacing effects will be small since the resistor is closer to the neck wall on one side of the tube axis but farther from the opposing wall. Assuming that the tube components with which the resistor 92 interacts to produce stray capacitance are uniformly located around the neck of the tube, it is believed that the off-axis location of the resistor will not produce a significantly increased effect on stray capacitance over that which would result if the resistor were located on the tube axis.

As noted also, by the present invention, due to the axial coextensiveness of the resistor and the anti-coating 94, any stray capacitance between the resistor and neck parts or tube components in the same axial region as the resistor will be in series with a high resistance, producing a heavy damping of any stray-capacitance-associated transients during any arcing which might occur.

The length of the resistor is important and brings into this discussion a number of design considerations—principally, beam obstruction, effective arc path length, and stray capacitance. The stray capacitance increases as a function of increasing resistor length. Thus from the standpoint of the minimized stray capacitance, ideally the resistor should be axially very short. It has been found, however, that it is of utmost importance in the interest of preventing arcs from jumping over a discrete arc suppression resistor, to have the effective arc path length as long as possible. This requirement demands that the resistor have a considerable length. As will be noted later in the specification, certain resistor geometries are possible which provide an increased arc path length in a relatively axially compact resistor geometry. However, at the same time it should be noted that attempts to provide long arc path lengths in a physically short resistor configuration often lead to geometries which are prone to arc-shortcutting. A good example is a helix which provides a long arc path length in a relatively short resistor geometry, however it has been found that with helical resistor configurations, during an arc the arc is very prone to jump from turn to turn of the helix rather than to follow the helical convolutions and to traverse the design arc path length.

The physical length and thickness of a resistor is very important also from the standpoint of beam interference. It is absolutely essential that any discrete arc suppression resistor not intrude into the space occupied by the beams at any time during their traverse of the screen. It has been found that an optimum length for the arc suppression resistor 92 exists. If the resistor is too short, it becomes prone to being jumped over by an arc. If the resistor is excessively long, however, it will intrude into the electron beam deflection space. It has been found that the length of the resistor 92, in a 100° deflection, narrow neck, in-line gun environment as shown, should be between 1.0 and 1.75 inches, preferably about 1.5 inches. The dynamic impedance of the resistor should fall somewhere in the range of a few kilohms to a few tens of megohms. At the low end of this range the arc protection provided is marginal. At the high end of the range the IR (current-resistance) drop across the resistor due to leakage current through the resistor and gun begins to adversely reduce the voltage on the anode electrode of the gun assembly 82. It has been found that a preferred dynamic impedance for the arc suppression resistor 92 is in the range of about 0.1–5 megohms.

Another very important consideration is the susceptibility of an arc suppression resistor to being shorted out by getter flash deposits. It has been found that due in large part to the geometry, orientation and location of the resistor 92, the arc suppression and static elimination system of the present invention is relatively immune to shorting by deposition of getter flash material which result when the getter is flashed. This is believed to result from two factors. First, the arc suppression resistor 92, due to its incorporation as part of the getter flash assembly, is inherently shielded from the getter flash source during getter flash by the flare region of the funnel. Second, the exposed surfaces of the arc suppression resistor are substantially parallel to the direction of getter flash deposition. Thus the conductive getter flash deposits impinge on the exposed surfaces of the resistor 92 at an extremely oblique angle, resulting in light deposition of the getter flash material.

The resistor 92 in its illustrated preferred embodiment has a ceramic rod 114 supporting the resistive coating 120. With this structure, a very high degree of mechanical strength and durability are provided for the resistor. The use of a resistive frit for the resistive coating 120 results in an overall resistor construction which is extremely durable and highly compatible with the clean high vacuum interior of a cathode ray tube.

Figure 8:
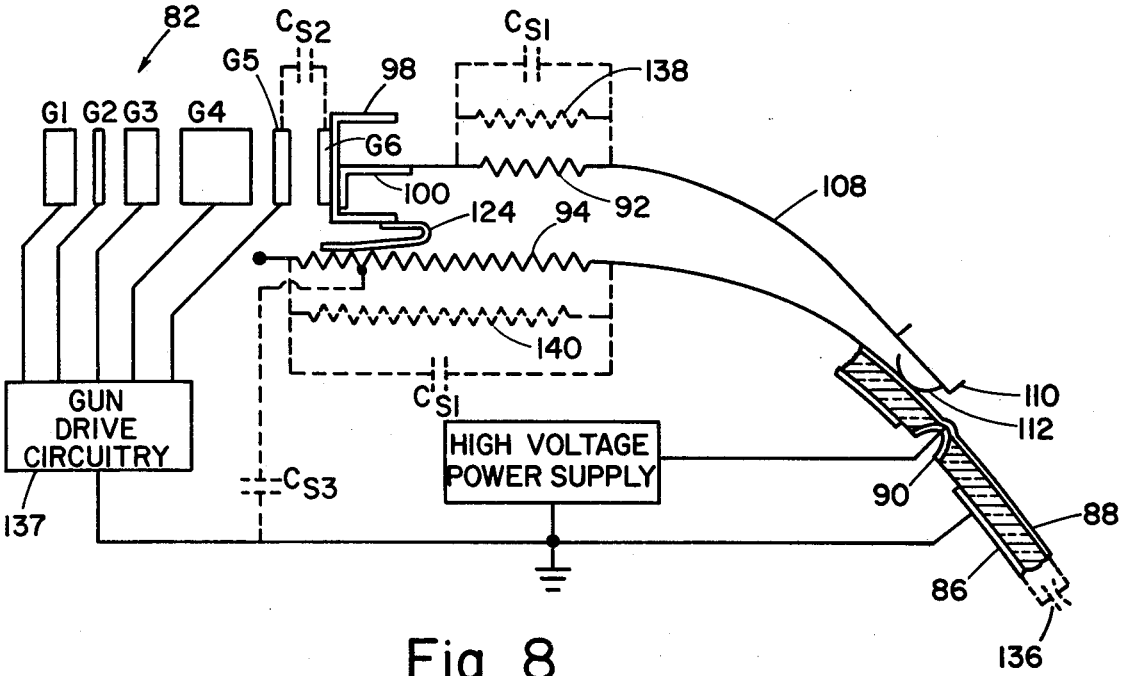
FIG. 8 is an electrical schematic representation of the tube components shown in FIG. 6.

A more detailed discussion of the system of parallel resistive elements for accomplishing arc suppression and static elimination will now be engaged, particularly with reference of FIG. 8. FIG. 8 is an electrical schematic diagram of the components of the FIG. 6 tube which are related to arcing, arc suppression or static elimination. The same reference numerals are used in the FIG. 8 electrical schematic diagram as used for corresponding structure in FIG. 6.

The high voltage filter capacitor constituted by the outer and inner conductive coatings 86 and 88 is shown symbolically in dotted lines at 136. It can be seen from FIG. 8 that the charged coatings 86 and 88 constitutes a large storage capacitor (1000–2000 picofarads, e.g.) ready at all times during tube operation to dump its charge to ground through any breakdown receptive pathway. It will be recognized that a protruding burr on one of the electrodes on the gun assembly 82 or a foreign particle in an inter-electrode space will create an arc inducive condition. Upon the occurrence of an arc, the high voltage filter capacitor 136 will dump its charge through the parallel-connected arc suppression resistor 92 and the anti-static coating 94, through the anode electrode 98 and thence through the gun drive circuitry 137 to ground.

The relative values of the arc suppression resistor 92 and the anti-static coating 94 are important, at least in applications wherein the net impedance of the parallel pair of resistors 92 and 94 is at the low end of the range of acceptable values. In applications wherein the net dynamic impedance of the system is quite low, for example, 10–100 kilohms, the level of arc current when arcing occurs would normally be in the range of a few amperes. At this level of arc current, it is desirable that the major part of the arc current pass through the arc suppression resistor 92 since the resistor is designed to withstand arc current at much higher levels than that. For the reasons given above, it is not desirable to pass large arc currents through an envelope coating. This means that in applications wherein the net impedance of the parallel system is 10–100 kilohms or so, the resistance of the arc suppression resistor should be much less (1/10 or less, e.g.) than the resistance of the anti-static coating 94. By this expedient, the amount of arc current that will pass through the anti-static coating 94 is low enough to avoid any possibility that the arc currents might chip neck glass, erode contact points or damage the coating 94.

The preferred dynamic impedance under arc conditions for the parallel resistive network comprising resistor 92 and coating 94 is in the order of 0.1–5 megohms. With an impedance in that range, any arc currents that will result will be relatively modest (less than 1 ampere). It is not so important therefore that a major portion of the arc current be diverted away from the anti-static coating 94. It is desirable that the anti-static coating not have a DC resistance much greater than $10^9$ ohms, since at that level the RC time constant associated with the discharge of stray charge from the coating begins to exceed a desirable maximum time interval. The DC resistance value of the parallel resistive network is preferably not greater than 30–50 megohms since above that range the IR drop resulting from gun leakage current flowing through the network will result in an unacceptable drop in the voltage on the anode electrode 98. In the preferred embodiment the anti-static coating has, for example, a resistance in the range of $10^7$–$10^9$ ohms. In the preferred embodiment the resistance value of the arc suppression resistor 92 is preferably about 0.1–5 megohms.

In FIG. 8 there is shown in dotted lines a resistor 138 shunting the arc suppression resistor 92. Resistor 138 is intended to symbolically represent a surface arc conduction path along the surface of the resistor which by-passes the body of the arc suppression resistor. A similar surface conduction by-pass path around the anti-static coating is symbolized by resistor 140.

Figure 1:
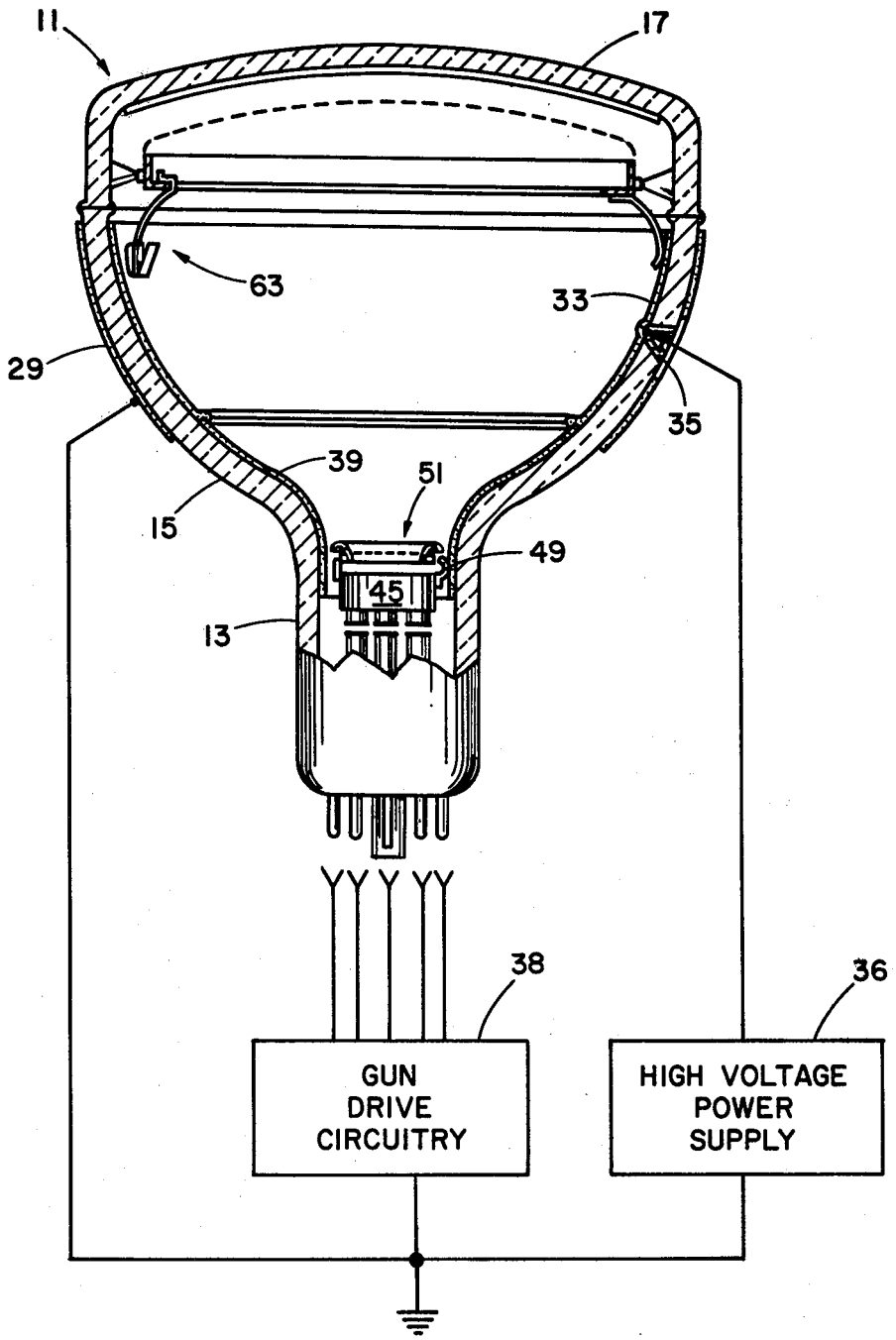
Fig. 1 PRIOR ART
FIG. 1 is a view of FIG. 1 of U.S. Pat. No. 3,979,633 with selected reference numerals removed and elements 36 and 38 added.
Figure 2:
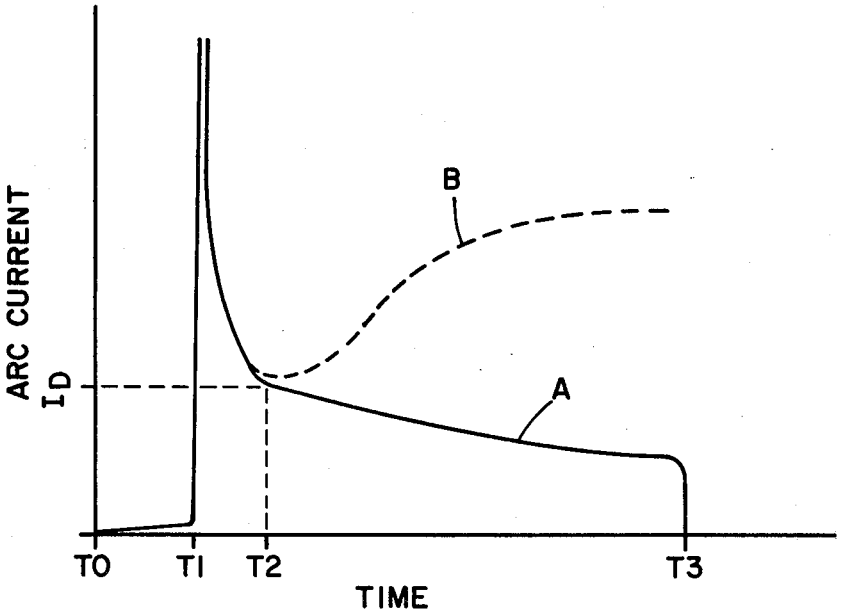
FIG. 2 is an arc-current-versus-time characteristic for a hypothetical prior art arc-suppressed television CRT.
Figure 3:
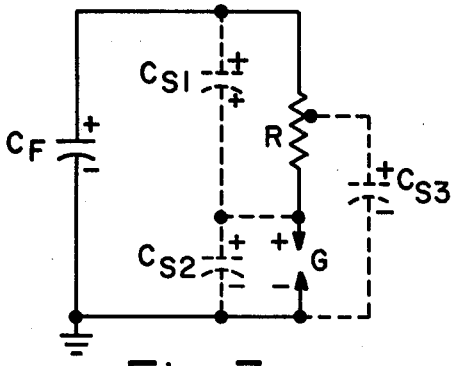
FIGS. 3–5 are highly schematic diagrams showing certain effects of stray capacitance on arcing in a tube.
Figure 4:
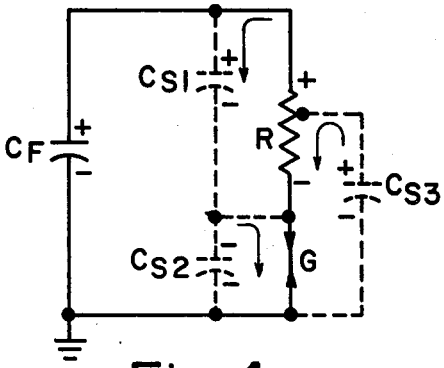

FIG. 8 also shows in symbolic form the same representative stray capacitance $C_{S1}$, $C_{S2}$, $C_{S3}$ described above in connection with FIGS. 3–5. Thus it is seen that the total arc suppression network is the sum of the parallel resistance 92, 94, 138 and 140 and all of the pertinent stray capacitances (here represented only by capacitances $C_{S1}$ and $C_{S3}$). If an arc current can find a low impedance path in any one or more of these branches of the system, then the system has failed in its job to protect the gun and associated chassis circuitry from high level arc currents.

By selecting appropriate values for the resistance of the arc suppression resistor 92 and anti-static coating 94, as described above, very adequate arc suppression will be achieved if the resistance values of the surface conduction resistors 138 and 140 are large enough and if the values of the stray capacitances are small enough. As described, due to the geometry orientation and location of the system comprising resistor 92 and anti-static coating 94, the small amount of getter material deposited on the exposed surfaces of these elements does not materially reduce the impedance of the system nor significantly increase the tendency of arcs to follow a surface conduction path by-passing the body of the resistor (the resistive coating 120 in the illustrated preferred embodiment).

As described in the referent application Ser. No. 803,907, the tolerance of the system to getter flash deposits is enhanced by causing the anti-static coating 94 and the arc suppression resistor 92 to each have a surface, the topography of which is abnormally irregularized as by the use of camphor in the resistive frit material during application thereof. Crystallization of the camphor acts to grossly contort and cavitate the surfaces of the resistive elements. As noted, it has been found that irregularization of the surface of the arc suppression resistor 92 and anti-static neck coating 94 may not be imperative in an embodiment as illustrated in FIG. 6 wherein the tube is of the small neck variety and these resistive elements have the FIGS. 6 and 7 geometry. The initial amount of getter material deposited, the angle of impingement of the getter material, and the limited area of the resistive elements exposed to getter flash apparently diminish the getter flash shorting problem.

A number of production prototype tubes have a parallel resistive network comprising an anti-static coating and discrete resistor as shown in FIG. 6 were constructed and very successfully tested. The getter in each tube was a standard gun-mounted, antenna-type gas-doped barium getter. The low voltage DC resistance of the resistive system was about 1 megohm. The tubes were given high voltage arcing tests and proved to hold up without arcing at 40 Kv, 45 Kv, 50 Kv or even higher before significant arcing occurred. When the tubes did arc, which was less often than in non-arc-suppressed tubes of similar construction, arc currents typically had a value of no more than a relatively harmless one ampere or less. The precursor spikes were a mere few amperes in magnitude—not enough to cause impairment of the tube or chassis structure or function.

Figure 9:
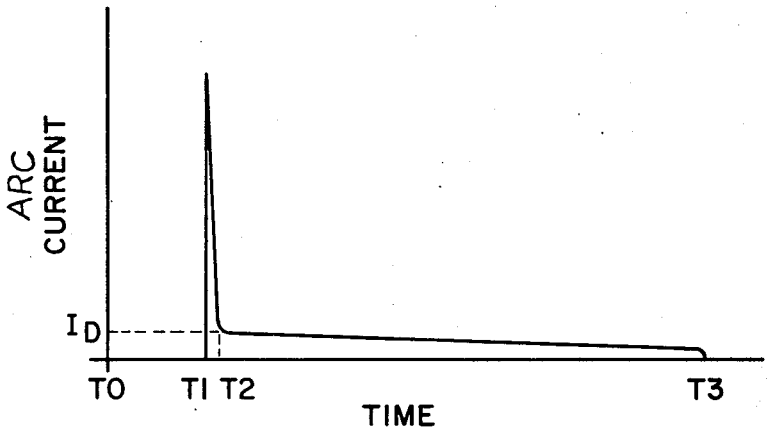
FIG. 9 is an arc-current-versus-time characteristic for a color CRT having an arc suppression and anti-static system as shown in FIG. 6.

A schematic representation of an arc current trace on an oscilloscope is shown in FIG. 9. The value $I_D$, the peak arc current, registered typically less than one ampere—for example 0.5 ampere. Assuming a breakdown voltage of 50 kilovolts, this implies a dynamic impedance of about 200,000 ohms. Typically, the measured dynamic impedance values for the prototype tubes tested fell in the range of 5–20 times lower than the low voltage DC resistance of the resistive system. The difference between the measured low voltage DC resistance values and the dynamic impedance values is believed to be due to the voltage sensitivity of the resistive elements and perhaps to high voltage aging of the resistors. The dynamic impedance values of the resistive elements is believed to be substantially equal to the high voltage DC resistance thereof.

The test results show the system according to this invention to be extremely effective in suppressing arcs to a level so low as to be incapable of causing damage to tube or chassis components or to impair the performance of either. The relative immunity of the FIG. 6 resistive system to the deposition of conductive material during getter flash has also been proved. Tests on prototype tubes as shown in FIG. 6 having resistive frit coatings 94, 120—a number made with and a number made without the use of camphor as a surface irregularization agent—showed a decrease in the low voltage DC resistance of the system by about 15–30%. We believe that the decrease in the dynamic impedance of this system due to flashing of the getter would be in the same order of magnitude. A drop of only 15–30% in the dynamic impedance of this system as a result of getter flash is not deemed to have a material effect on the performance of the system.

As stressed many times before, one of the chief attributes of the system of parallel resistance elements comprising a discrete arc suppression resistor paralleled with an anti-static neck coating having a very high resistance, is the very low stray capacitance of the system and the fact that much of the stray capacitance is strongly damped by the presence of resistance in series therewith. The low stray capacitance of the system, even in spite of getter flash deposits, assures that the dynamic impedance of the system to arc currents remains at substantially the same high level as the DC resistance of the system before arcing occurs.

The production prototype tubes made and successfully tested had irregularized coatings 94, 120 of resistive frit material. The resistive material utilized for the coatings 94, 120 was resistive frit material containing a metallic modifier such as tin oxide in an amount appropriate to give the frit the desired resistivity. The thickness of the coating 120 was about 2 mils. The coating 94 was caused to have a higher resistance by making it thinner than coating 120—e.g., a few ten thousandths of an inch thick.

A method by which the surface of the resistive coatings may be caused to have the afore-described porated, heavily cavitated and contorted surface will now be described. The resistive frit coating may have the following composition, prepared in the form of a suspension: 7.2 grams of ball-milled resistive frit supplied by Corning Glass Works of Corning, New York as Glass 8464; 1.8 grams of vehicle F1300A supplied by the Pierce and Stevens Company of Buffalo, New York, or equivalent; 1.8 grams of camphor; and 1.2 grams of ethyl propionate or equivalent. The suspension may be applied by brushing, spraying, dipping or other suitable process. The thickness of the coating will affect the resistance thereof—the thinner the coating, the greater its resistance. The resistance of the coating can thus be controlled booth by the amount of metallic inclusion and by the coating thickness.

The surface irregularizing agent in the formulation being discussed is camphor. Crystallization of the camphor from the suspension causes the surface of the coating to have the afore-described extremely irregular topography. The next step in the method of coating fabrication under description is to vacuum bake the coating, for example for 20 minutes at about 430° C. This step can be accomplished as part of the normal exhaust cycle. This has the effect of devitrifying the frit to form an extremely hard and abrasion-resistant vitreous coating. During the vacuum bake step, the resistance of the coating achieves its ultimate useful value which may be several orders of magnitude less than its resistance after air bake.

Whereas the preferred geometry of the arc suppression resistor is shown in FIG. 6 as being in the form of an elongated straight nrrow cylinder, other resistor configurations are contemplated which could meet the afore-described requirements. For example, a resistor may be employed which has a non-cylindrical cross-section—for example, a cross-section elongated or flattened in a direction substantially parallel to the plane of the electron beams. Rather than being straight, the resistor may follow the contour of the flare region of the funnel. To provide an extended arc path length, a resistive coating on a substrate may be devised to have an extended effective length if the surface of the substrate upon which the resistive coating is deposited is caused to have an undulating surface, or the resistor might have an overall contoured serpentine geometry, as that which would be taken by a snake crawling over the flare region of the funnel. In both of these extended path length configurations, care must be taken that the ultimate configuration is not one in which an arc can skip from undulation to undulation and thereby by-pass the major part of the effective length of the resistor. The resistor may be a bulk resistor of suitable resistive material, rather than a substrate coated with a resistive material. Where a resistive coating is employed, suitable coating compositions other than resistive frit may be used. Whereas the resistor 92 has been described as being employed in electrical combination with a resistive anti-static coating, it is contemplated that a resistor constructed in accordance with this invention may be employed alone as an arc suppressor, i.e. in systems which do not have an anti-static coating in combination therewith. Whereas in the described preferred embodiment the associated electron gun comprises three coplanar electron beams, the invention may be utilized with single beam guns and guns of other geometries.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. An electron gun for generating at least one electron beam, said gun being characterized by having an elongated discrete arc suppression resistor having length-to-width ratio is about 8:1 to 20:1 mounted on an anode electrode of the gun in cantilever fashion at a point spaced from said beam so as not to interfere therewith, said resistor extending substantially axially and supporting on the distal end a getter strap to which it is electrically connected, said getter strap in turn supporting a getter pan assembly containing a vaporizable getter material.

2. In a color television cathode ray tube including an evacuated glass envelope having on an external surface of a funnel portion thereof an outer coating and on an internal surface thereof an inner coating for receiving a high voltage charge, said coatings and funnel collectively constituting a high voltage filter capacitor, said tube further including an in-line type electron gun located in a neck of the funnel, which gun generates three electron beams which exist in a common horizontal plane when undeflected, said gun being characterized by having an elongated discrete arc suppression resistor with a length-to-width ratio of about 8:1 to 20:1 mounted on an anode electrode of the gun in cantilever fashion at a point vertically spaced from said plane of said three beams so as not to interfere with said beams, said resistor extending substantially axially between said anode electrode and a flare region of said neck where the neck expands into the funnel, said arc suppression resistor supporting on the distal end thereof a curved getter strap to which it is electrically connected, said better strap following the contour of said funnel flare region, and supporting in contact with said inner coating a getter pan assembly containing a vaporizable getter material.

3. The apparatus defined by claim 2 wherein said resistor comprises a straight insulative rod mounted at a slight angle away from the gun axis and carrying an axially homogeneous resistive coating.

4. In a color television cathode ray tube of the small neck type including an evacuated glass envelope having on an external surface of a funnel portion thereof an outer coating and on an internal surface thereof an inner coating for receiving a high voltage charge, said coatings and funnel collectively constituting a high voltage filter capacitor, said tube further including an electron gun located in a neck of the funnel, which gun generates at least one electron beam, said gun being characterized by having a discrete arc suppression resistor in the form of an elongated rod mounted on an anode electrode of the gun in cantilever fashion at a point spaced from said beam so as not to interfere therewith, said rod having a minimized surface area per unit of length for minimized stray capacitance and maximized beam clearance but establishing a relatively great arc path length to minimize the likelihood of an arc jumping thereacross, said rod extending substantially axially between said anode electrode and a region of said neck where the neck expands into the funnel, said rod supporting on the distal end thereof and being connected to a curved getter strap following the contour of said funnel flare region, said getter strap in turn supporting in contact with said inner coating a getter pan assembly containing a vaporizable getter material, said arc suppression resistor being relatively immune to being shorted by deposits of conductive getter material when the getter material is flashed, due to the location of the resistor behind the said funnel flare region and due also to the substantial parallelism of the outer surface of the resistor with the direction of getter material deposition.

5. The apparatus defined by claim 4 wherein said rod comprises a straight, long and narrow insulative cylindrical rod carrying a resistive coating, said rod having a length-to-width ratio of about 8:1 to 20:1.

6. In a color television cathode ray tube including an evacuated glass envelope having on an external surface of a funnel portion thereof an outer coating and on an internal surface thereof an inner coating for receiving a high voltage charge, said coatings and funnel collectively constituting a high voltage filter capacitor, said tube further including an electron gun located in a neck of the funnel, which gun generates at least one electron beam, said tube being characterized by having an improved arc suppression and static elimination system comprising a discrete arc suppression resistor in the form of an elongated discrete resistor mounted on an anode electrode of the gun in cantilever fashion at a point spaced from said beam so as not to interfere therewith, said resistor having a minimized surface area per unit of length for minimized stray capacitance and maximized beam clearance but establishing a relatively great arc path length to minimize the likelihood of an arc jumping thereacross, said resistor extending substantially axially between said anode electrode and a flare region of said neck where the neck expands into the funnel, said resistor supporting on the distal end thereof and being electrically connected to a curved, electrically conductive getter strap following the contour of said funnel flare region, said getter strap in turn supporting in physical and electrical contact with said inner coating a getter pan assembly containing a vaporizable getter material, said system further including in electrically parallel combination with said arc suppression resistor, an anti-static coating on an inner surface of the neck around the beam egress from said gun and having a dynamic impedance value which is significantly greater than that of said arc suppression resistor such that said resistor carries the major part of any arc currents passing through said system, whereby effective arc suppression and static elimination are achieved with high dynamic impedance and with an insubstantial likelihood of said system being by-passed as a result of stray capacitance in the system.

7. The apparatus defined by claim 6 wherein said resistor comprises a straight insulative rod mounted at a slight angle away from the gun axis and carrying an axially homogeneous resistive coating.

8. In a color television cathode ray tube of the small neck type including an evacuated glass envelope having on an external surface of a funnel portion thereof an outer coating and on an internal surface thereof an inner coating for receiving a high voltage charge, said coatings and funnel collectively constituting a high voltage filter capacitor, said tube further including an in-line type electron gun located in a neck of the funnel, which gun generates three electron beams which exist in a common horizontal plane when undeflected, said tube being characterized by having an arc suppression and static elimination system comprising a discrete arc suppression resistor in the form of a rod mounted on an anode electrode of the gun in cantilever fashion at a point vertically spaced from said plane of said three beams so as not to interfere with said beams, said rod having an axially homogeneous resistive coating, said arc suppression resistor having a minimized surface area per unit of length for minimized stray capacitance and maximized beam clearance but establishing a relatively great arc path length to minimize the likelihood of an arc jumping thereacross, said rod extending substantially axially between said anode electrode and a flare region of said neck where the neck expands into the funnel, said rod supporting on the end thereof a curved, electrically conductive getter strap following the contour of said funnel flare region, said getter strap in turn supporting in physical and electrical contact with said inner coating a getter pan assembly containing vaporizable electrically conductive getter material, said system further comprising in electrically parallel combination with said rod, a resistive anti-static coating on an inner surface of the neck around the beam egress from said gun and axially coextensive with said resistor and having a dynamic impedance value which is significantly greater than that of said rod such that said rod carries the major part of any arc currents passing through said system, said system being relatively immune to shorting by deposits of conductive getter material when the getter material is flashed due to the location of the rod behind the said funnel flare region and due also to the near parallelism of the outer surface of the rod coating and the anti-static coating with the direction of getter material deposition, whereby effective arc suppression and static elimination are achieved with high dynamic impedance and with an insubstantial likelihood of said system being by-passed as a result of getter flash shorting or stray capacitance in the neck region of the tube.

9. The apparatus defined by claim 8 wherein said rod comprises a straight, long and narrow ceramic cylinder carrying a resistive coating composed of a resistive frit material, said rod having a length-to-width ratio of about 8:1 to 20:1.

* * * * *